US007845139B1

(12) United States Patent
Mansueto et al.

(10) Patent No.: US 7,845,139 B1
(45) Date of Patent: Dec. 7, 2010

(54) CLOSURE FRAME CORNER JOINT

(75) Inventors: Richard Mansueto, Gig Harbor, WA (US); Jess Valler, Olympia, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 0 days.

(21) Appl. No.: 12/843,562

(22) Filed: Jul. 26, 2010

Related U.S. Application Data

(60) Division of application No. 12/718,608, filed on Mar. 5, 2010, now Pat. No. 7,784,239, which is a continuation of application No. 12/235,702, filed on Sep. 23, 2008, now Pat. No. 7,698,871.

(51) Int. Cl.
*E04C 2/38* (2006.01)

(52) U.S. Cl. ..... 52/745.15; 52/656.7; 29/525.01; 29/525.11

(58) Field of Classification Search ..... 52/656.9, 52/656.7, 127.12, 656.4, 656.5, 656.6, 656.2, 52/456, 745.15, 745.19, 127.7; 403/187, 403/205, 252, 255, 258, 259, 292, 294, 295, 403/331, 382, 403, 231; 29/525.01, 525.02, 29/525.11, 897.3
See application file for complete search history.

(56) References Cited

U.S. PATENT DOCUMENTS 1,961,006 A * 5/1934 Marty ..... 52/800.16
2,634,525 A * 4/1953 Levine ..... 38/77.6
2,727,595 A * 12/1955 Beltman ..... 52/364
2,970,677 A * 2/1961 Springs, Jr. et al. ..... 52/769
3,017,970 A * 1/1962 Nickols ..... 52/127.12
3,299,596 A * 1/1967 Neal et al. ..... 52/476
3,357,661 A * 12/1967 Aakjar ..... 248/662
3,375,030 A * 3/1968 Thompson ..... 403/231
3,574,378 A * 4/1971 Heywood ..... 403/231
3,915,579 A * 10/1975 Offenbroich ..... 403/264
4,109,429 A * 8/1978 Whisson ..... 52/126.4
4,665,663 A * 5/1987 Governale ..... 52/456

(Continued)

FOREIGN PATENT DOCUMENTS

DE 2646351 A * 5/1977

(Continued)

*Primary Examiner*—Robert J Canfield
*Assistant Examiner*—Babajide Demuren
(74) *Attorney, Agent, or Firm*—Reising Ethington PC

(57) ABSTRACT

A closure frame includes at least one end rail, at least one side rail and a corner joint between ends of the corner and side rails. The corner joint includes a rail insert secured within a first of the rails. A threaded fastener is secured against rotation within the insert and extends from an open end of the first rail into a second of the rails. A nut is disposed within the second rail in threaded engagement with the end of the fastener and clamps the second rail against the open end of the first rail. The corner joint preferably is a butt joint, and a pair of rail inserts preferably are disposed within the end of the first rail so that a pair of threaded fasteners extend into the second rail and are engaged by associated nuts in the second rail. A washer plate preferably is disposed in the second rail beneath the nuts, and a gasket preferably is disposed between the second rail and the open end of the first rail to seal the corner joint.

8 Claims, 2 Drawing Sheets

U.S. PATENT DOCUMENTS 5,261,203 A * 11/1993 Yoon ..... 52/455
5,363,625 A * 11/1994 Philippi ..... 52/653.2
5,653,074 A * 8/1997 Yoon ..... 52/210
5,655,348 A * 8/1997 Paradise ..... 52/656.4
5,875,600 A * 3/1999 Redman ..... 52/656.4
7,077,263 B1 * 7/2006 Richardson et al. ..... 198/844.2
7,216,855 B2 * 5/2007 Platt ..... 256/65.03
2006/0048476 A1 * 3/2006 Krapf et al. ..... 52/656.9
2008/0159806 A1 * 7/2008 Niswonger ..... 403/231

FOREIGN PATENT DOCUMENTS

GB 2134205 A * 8/1984

* cited by examiner

CLOSURE FRAME CORNER JOINT

This application is a division of application Ser. No. 12/718,608 filed Mar. 5, 2010, which was a continuation of application Ser. No. 12/235,702 filed Sep. 23, 2008 and now abandoned.

The present disclosure relates to building closure assemblies such as windows and doors, and more particularly to a frame corner joint for such a closure assembly.

BACKGROUND AND SUMMARY OF THE DISCLOSURE

Building closure assemblies of current design, such as patio screens and doors, typically require several screws to form a butt joint at each corner of the frame. Alignment and assembly at the four corners of the frame can be a laborious and costly operation. It is a general object of the present disclosure to provide a corner joint, preferably a corner butt joint, for a building closure frame that can be economically fabricated.

The present disclosure embodies a number of aspects that can be implemented separately from or in combination with each other.

A closure frame in accordance with one aspect of the present disclosure includes at least one end rail, at least one side rail and a corner joint between ends of the corner and side rails. The corner joint includes a rail insert secured within a first of the rails. A threaded fastener is secured against rotation within the insert and extends from an open end of the first rail into a second of the rails. A nut is disposed within the second rail in threaded engagement with the end of the fastener and clamps the second rail against the open end of the first rail. The corner joint preferably is a butt joint, and a pair of rail inserts preferably are disposed within the end of the first rail so that a pair of threaded fasteners extend into the second rail and are engaged by associated nuts in the second rail. A washer plate preferably is disposed in the second rail beneath the nuts, and a gasket preferably is disposed between the second rail and the open end of the first rail to seal the corner joint.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
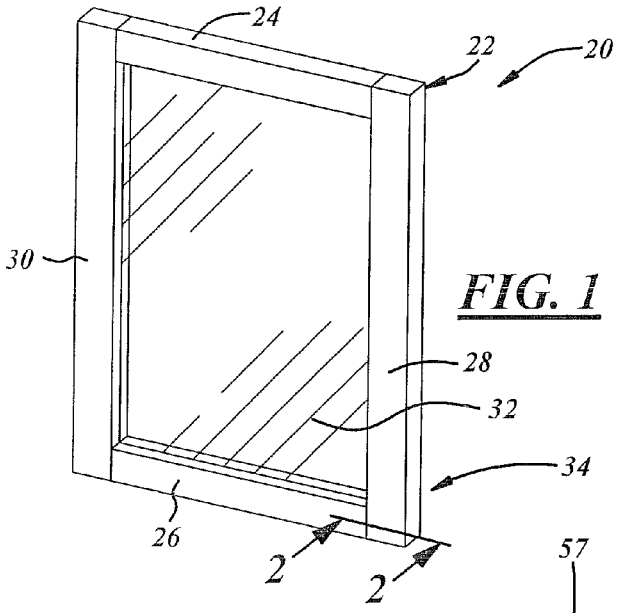
FIG. 1 is a perspective view of a closure assembly that includes a closure frame in accordance with an exemplary embodiment of the present disclosure.

FIG. 1 illustrates a building closure 20 in the form of a patio door in accordance with an exemplary embodiment of the present disclosure. Closure 20 includes a rectangular frame 22 having a pair of end rails 24, 26 and a pair of stiles or side rails 28, 30. A glass or plastic pane 32 is illustrated within frame 22. Rectangular frame 22 has a butt joint at each corner of the frame, with joint 34 at the lower right corner of FIG. 1 being illustrated in detail in FIGS. 2-3. All of the corner joints preferably are identical.

Figure 5:
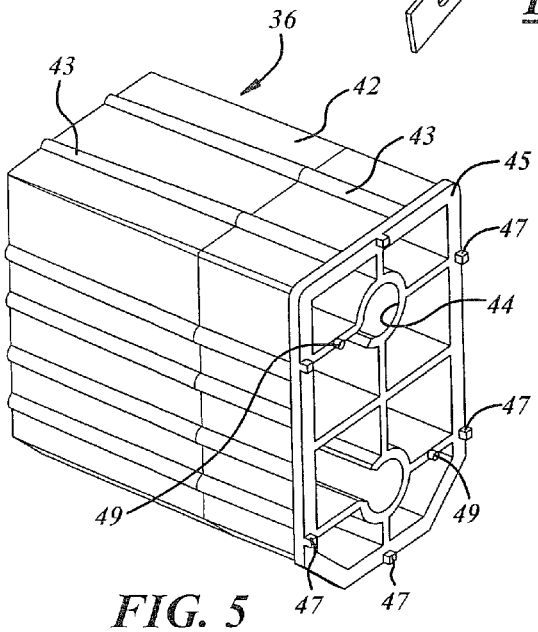
FIG. 5 is a front perspective view of the rail insert in FIG. 4.
Figure 4:
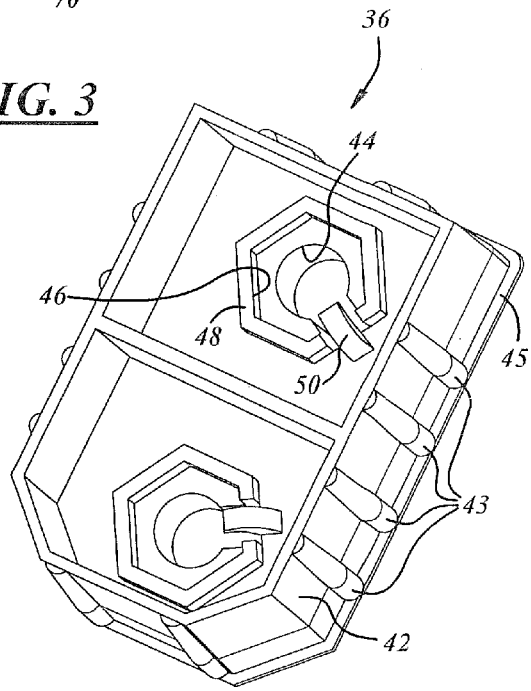
FIG. 4 is a rear perspective view of a rail insert in the corner joint illustrated in FIGS. 2 and 3.

Frame corner butt joint 34 includes at least one rail insert 36, preferably a pair of rail inserts 36 received within associated hollow chambers 38, 40 at the open end of rail 26. Rails 24-30 preferably are of extruded construction such as metal or plastic. Insert 36 preferably is of molded plastic or metal construction having a periphery 42 generally conforming to the geometry of the chamber 38 or 40 (preferably having identical geometries) into which the insert is to be placed. A plurality of spaced parallel ribs 43 extend along the sides of the insert periphery and radially outwardly from the periphery. There is an outwardly extending flange 45 around the front face of insert 36. A plurality of pegs 47, 49 extend axially from flange 45 and from the front face of the insert. Each insert 36 has at least one through-opening 44 that extends from the front face of the insert (FIG. 5) to the back face (FIG. 4). Outer pegs 47 around the perimeter of insert 36 are for indicating the depth of press fit of the inserts into the rail. Inner pegs 49 allow for alignment of gasket 68, if needed. There are two through-openings 44 in each insert to allow the bolt to be installed in either or both openings. The back face of the insert is recessed to facilitate molding and to provide a good lead-in for assembly purposes.

Figure 2:
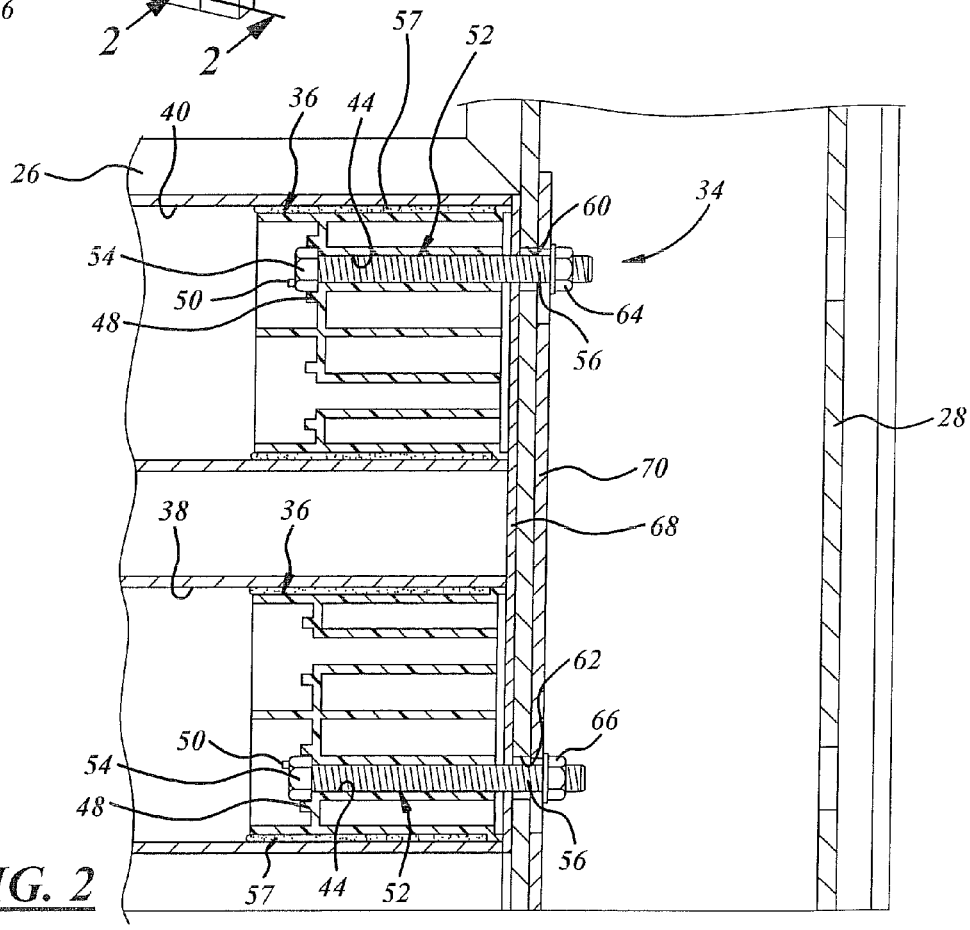
FIG. 2 is a fragmentary sectional view taken substantially along the line 2-2 in FIG. 1.
Figure 3:
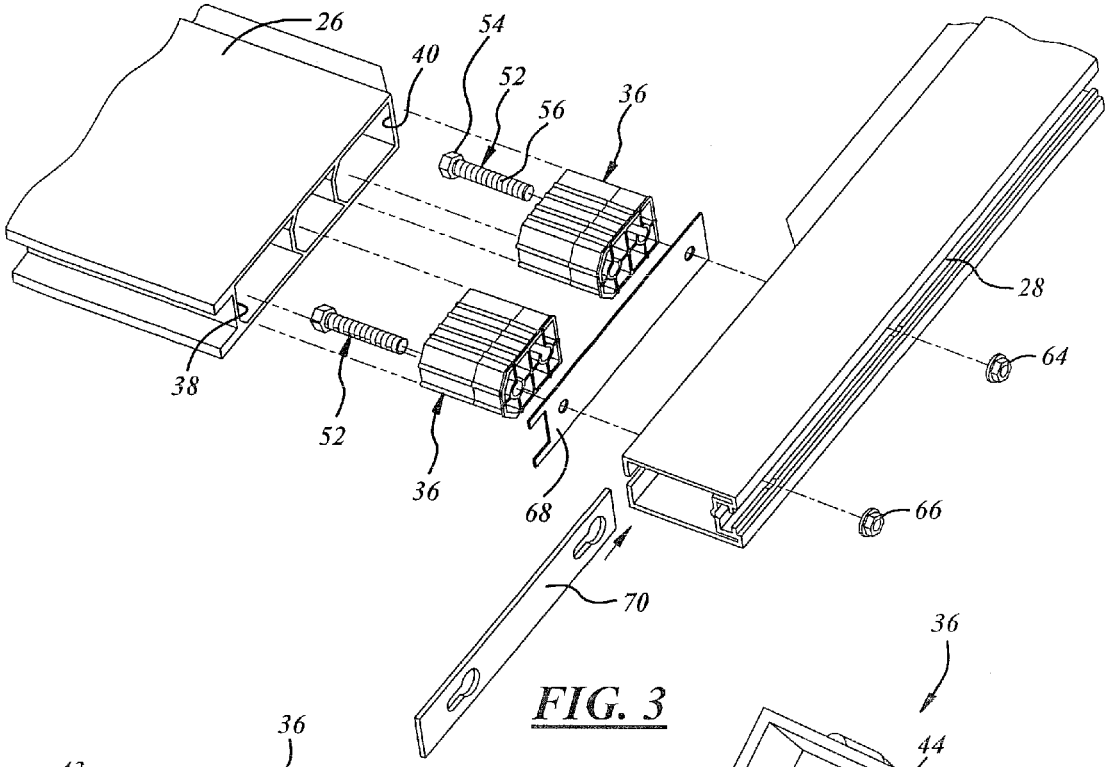
FIG. 3 is an exploded perspective view of the frame corner joint illustrated in FIG. 2.

The back face of insert 44 has a pocket 46 around through-opening 44. Pocket 46 preferably is non-circular, such as hexagonal as best seen in FIG. 4. This hexagonal pocket 46 preferably is formed by a hexagonal wall 48 upstanding from the back face of the insert surrounding and coaxial with through-opening 44. A finger 50 extends from the back face of the insert and partially overlies pocket 46 for purposes to be described. Wall 48 can be interrupted at finger 50, as best seen in FIG. 4. FIGS. 2-4 illustrate inserts 36 each having a pair of through-openings 44 and associated recesses 46. Only one of these through-openings and recesses in each insert is employed in the exemplary embodiment of the disclosure.

A threaded fastener 52 is carried by each insert 36. Fastener 52 preferably comprises a standard hex-head bolt having a head 54 non-rotatably captured within pocket 46 of insert 36, and a threaded shank 56 that extends through insert through-opening 44 and outwardly from the front face of the insert. Finger 50 of insert 36 extends over and captures head 54 of bolt 52 within pocket 46, while the preferred hexagonal geometries of head 54 and pocket 46 prevent rotation of bolt 52 with respect to insert 36.

The assembly of bolt 52 and insert 36 is then secured within chamber 38 or 40 of rail 26, preferably by applying a layer 57 of adhesive 57 to the external periphery 42 of insert 36 prior to insertion of the insert into the end of the rail. Ribs 43 are press-fitted into the rail chamber and the adhesive is disposed between the ribs. Flange 45 seals the end of chamber 38 or 40 and helps prevent leakage of adhesive. The threaded ends of bolts 52 extend from the open end of rail 26.

Side rail or stile 28 is then assembled against the open end of rail 26. This is accomplished by placing openings 60, 62 (FIG. 2) of rail 28 over the threaded ends of shanks 56. Nuts 64, 66 are then threaded onto the ends of bolts 52 firmly to clamp side rail 28 against the open end of end rail 26. A gasket 68 preferably is placed between the open end of rail 26 and the opposing face of rail 28 to the seal the joint against leakage. A washer plate 70 preferably is inserted into the end of rail 28 and located beneath nuts 64, 66.

There thus has been disclosed a closure frame, and particularly a closure frame corner joint, that fully satisfies all of the objects and aims previously set forth. The present disclosure has been presented in conjunction with an exemplary embodiment, and additional modifications and variations have been discussed. Other modifications and variations readily will suggest themselves to persons of ordinary skill in the art in view of the foregoing description. For example, the disclosure is by no means limited to corner butt joints but could be implemented in conjunction with corner mitered joints, for example. Nor is the disclosure limited specifically to doorframes, or to rectangular frames. For example, the disclosure could be implemented in conjunction with part-circular decorative windows. The disclosure is intended to embrace all such modifications and variations as fall within the spirit and broad scope of the appended claims.

The invention claimed is:

1. A method of making a closure assembly that includes at least one end rail, at least one side rail and a butt corner joint between said end rail and said side rail, said method including the steps of:

(a) assembling a threaded fastener to a rail insert such that the threaded fastener is non-rotatable within said insert and includes a head that is disposed in a pocket of said insert and is captured by a finger of said insert at least partially overlying said pocket, and a threaded shank of said fastener extends from said head and through a through opening of said insert and further extends from an end of said insert, (b) inserting said insert into an open end of a first of said rails such that said threaded shank extends from said open end, (c) placing a second of said rails against said open end of said first rail over said threaded shank such that said threaded shank extends into said second rail, and (d) clamping said second rail to said open end of said first rail by tightening a nut onto said threaded shank.

2. The method set forth in claim 1 wherein said step (b) includes applying adhesive around said insert to secure said insert within said open end.

3. The method set forth in claim 1 wherein said step (a) includes:

(a1) providing a non-circular pocket in said insert and a through-opening extending through said insert from said pocket, (a2) providing a non-circular head on said fastener, and (a3) assembling said fastener to said insert by inserting a threaded shank of said fastener through said through-opening and seating said head within said pocket.

4. The method set forth in claim 3 wherein is said head and said pocket are of hexagonal geometry.

5. A method of making a closure assembly that includes at least one end rail, at least one side rail and a butt corner joint between said end rail and said side rail, said method including the steps of:

(a) assembling a threaded fastener to a rail insert such that a non-circular head of the threaded fastener is non-rotatable within a non-circular pocket of said insert so that said head is non-rotatable in said pocket and so that a finger of said insert captures said head in said pocket, and a threaded shank of said fastener extends from an end of said insert, (b) inserting said insert into an open end of a first of said rails such that said threaded shank extends from said open end, (c) placing a second of said rails against said open end of said first rail over said threaded shank such that said threaded shank extends into said second rail, and (d) clamping said second rail to said open end of said first rail by tightening a nut onto said threaded shank.

6. The method set forth in claim 5 wherein said step (b) includes applying adhesive around said insert to secure said insert within said open end.

7. The method set forth in claim 5 wherein said step (a) includes:

(a1) providing a non-circular pocket in said insert and a through-opening extending through said insert from said pocket, (a2) providing a non-circular head on said fastener, and (a3) assembling said fastener to said insert by inserting a threaded shank of said fastener through said through-opening and seating said head within said pocket.

8. The method set forth in claim 7 wherein is said head and said pocket are of hexagonal geometry.

* * * * *